United States Patent [19]

Schwartz et al.

[11] 4,391,722

[45] Jul. 5, 1983

[54] WATER-BASED LOW FOAM HYDRAULIC FLUID EMPLOYING 2-ETHYLHEXANOL DEFOAMER

[75] Inventors: Ellen S. Schwartz, Warren; Cline A. Tincher, Grosse Ile, both of Mich.; Jerrold F. Maxwell, Matteson, Ill.

[73] Assignee: BASF Wyandotte Corporation, Wyandotte, Mich.

[21] Appl. No.: 253,809

[22] Filed: Apr. 13, 1981

[51] Int. Cl.[3] ..... C09K 3/00; C10M 3/04

[52] U.S. Cl. ..... 252/73; 252/49.3; 252/74; 252/75; 252/76; 252/77; 252/78.1

[58] Field of Search ..... 252/49.3, 49.5, 73–76, 252/77, 78.1

[56] References Cited

U.S. PATENT DOCUMENTS

| | | | |
|---|---|---|---|
| 2,753,305 | 7/1956 | Whitbeck | 252/49.3 |
| 2,909,489 | 10/1959 | Fields | 252/78 |
| 3,032,504 | 5/1962 | Doelling | 252/79 |
| 4,138,346 | 2/1979 | Nassry | 252/74 |
| 4,151,099 | 4/1979 | Nassry | 252/76 |
| 4,250,046 | 2/1981 | Przbylinski | 252/49.3 |
| 4,312,768 | 1/1982 | Nassry | 252/74 |

OTHER PUBLICATIONS

McCutcheon's Detergents & Emulsifiers, 1976, Functional Materials, ©1976, pp. 54–58.

*Primary Examiner*—John D. Smith

*Attorney, Agent, or Firm*—Andrew E. Pierce; Bernhard R. Swick

[57] ABSTRACT

In accordance with the instant invention, a water-based hydraulic fluid, having improved low foaming properties can be obtained by blending 2-ethylhexanol with a conventional water-based hydraulic fluid composition.

12 Claims, No Drawings

WATER-BASED LOW FOAM HYDRAULIC FLUID EMPLOYING 2-ETHYLHEXANOL DEFOAMER

BACKGROUND OF THE INVENTION

1. Field of the Invention

This invention relates to water-based hydraulic fluids characterized by reduced foaming properties.

2. Prior Art

In the technology of hydraulic power transmission, mechanical power is imparted to a fluid called "a hydraulic fluid" in the form of pressure by means of a hydraulic pump. Power is utilized where desired by tapping a source of said hydraulic fluid thus transforming the power as pressure back to mechanical motion by a mechanism called a hydraulic motor. The hydraulic fluid is utilized as a pressure and volume transmitting medium. Any non-compressible fluid can perform this function. Water is the oldest fluid used for this purpose and is still sometimes used alone for this purpose. In the prior art, there has been a heavy emphasis on the development of petroleum oils for use as hydraulic fluids and, consequently, much of the equipment utilized with hydraulic fluids has been designed and manufactured specifically for use with petroleum oils. A petroleum oil in comparison with water as a hydraulic fluid possesses the advantage of inhibiting the development of rust of the ferrous components of the mechanical equipment utilized in conjunction with hydraulic fluids, (i.e., hydraulic pumps, motors, etc.) and in preventing wear of the machinery since the hydraulic fluid must lubricate the equipment. Petroleum oils have a second advantage over the use of water as a hydraulic fluid in that the petroleum oils normally exhibit a substantially higher viscosity than water and thus contribute to reduction of the leakage of the fluid in the mechanical equipment utilized. In addition, the technology relating to additives for petroleum oils has developed to such an extent that the viscosity, foam stability, wear prevention and corrosion prevention properties of such petroleum oil-based hydraulic fluids can be further enhanced by the use of said additives.

Over the past 25 years, various substitutes for petroleum oil-based hydraulic fluids have been developed in order to overcome one of the major deficiencies of petroleum oils, namely, flammability. Recent interest in the use of hydraulic fluids having up to 99 percent or more of water has resulted from the higher cost of petroleum oils and recent emphasis on problems of ecologically suitable disposal of contaminated or spent petroleum oil-based hydraulic fluids.

Metalworking fluids of the so-called "soluble oil" type have been considered for use as hydraulic fluids. Such fluids contain mineral oil and emulsifiers as well as various additives to increase corrosion resistance and improve antiwear and defoaming properties. Such fluids, when used as hydraulic fluids, are not generally suitable for use in ordinary industrial equipment designed specifically for use with the petroleum oil-based hydraulic fluids since such fluids do not adequately prevent wear damage in pumps and valves of such equipment. However, such fluids have found application in specially designed, high cost, large size equipment which, because of said large size and thus inflexibility, is not suitable for use in most industrial plants. The soluble oil hydraulic fluid usage has thus been quite limited; usage has been largely confined to large installations where flexibility and size are not critical, such as in steel mills.

Many prior art fluids, such as the petroleum oil type, are highly flammable and unsuitable for certain uses where such fluids have frequently been the source of fire. Where these fluids are used to control such industrial operations as heavy casting machines, which are operated largely by hydraulic means, danger of fire exists. Therefore, there is a growing demand for hydraulic fluids characterized by reduced flammability.

It is also known to use, in equipment designed for use with mineral oil-based hydraulic fluids, flame-resistant glycol-water-based hydraulic fluids such as are disclosed in U.S. Pat. No. 2,947,699.

Hydraulic fluid compositions having water as a base are disclosed in U.S. Pat. Nos. 4,151,099 and 4,138,346. These patents disclose fluids comprising (1) a sulfur containing compound and (2) a phosphate ester salt. The U.S. Pat. No. 4,151,099 also includes a water-soluble polyoxyethylated ester of an aliphatic acid and an monohydric or polyhydric aliphatic alcohol, either one or both said acid and said alcohol being polyoxyethylated.

U.S. Pat. No. 2,710,842 discloses the use of antifoam agents in hydraulic fluids. However, the only antifoam agents disclosed are silicone polymers.

U.S. Pat. No. 2,753,305 discloses a lubricating composition comprising a water-soluble or water-dispersible lubricant and 2-ethylhexanol as a defoamer.

SUMMARY OF THE INVENTION

It has been discovered in accordance with the instant invention that the addition of small but effective amounts of 2-ethylhexanol to otherwise conventional water-based hydraulic fluids results in improved low-foam properties.

DESCRIPTION OF THE PREFERRED EMBODIMENTS

In accordance with the instant invention, a water-based hydraulic fluid, having improved low-foam properties can be obtained by blending 2-ethylhexanol with a conventional water-based hydraulic fluid composition.

The 2-ethylhexanol described above may be employed with any conventional hydraulic fluid incorporating any or all of the following prior art components. For example, the hydraulic fluid may contain, as disclosed in U.S. Pat. Nos. 4,151,099 and 4,138,346, a phosphate ester, a sulfur compound, and a water-soluble polyoxyethylated aliphatic ester or ether. Optionally, the fluids of the invention can include corrosion inhibitors, additional defoamers and a metal deactivator (chelating agent) as well as other conventional additives, such as dyes in normal amounts.

In accordance with this invention, it has been discovered that compositions useful as hydraulic fluids can be prepared having desirable low foam properties. Generally, concentrates of the hydraulic fluids of the invention are shipped to the point of use where they are diluted with tap water. The compositions of the invention provide improved results over prior art fluids even when diluted with hard water.

Water-soluble esters of ethoxylated aliphatic acids and/or water soluble ethers of ethoxylated alcohols may be incorporated in the hydraulic fluid as an additional anti-wear lubricant component. Preferred water-soluble ethers or esters are those of the ethoxylated $C_8$–$C_{36}$ aliphatic monohydric or polyhydric alcohols or aliphatic acids, and aliphatic dimer acids. Suitable esters of ethoxylated aliphatic acids or alcohols are disclosed in U.S. Pat. No. 4,151,099 particularly beginning in column 3 thereof which is hereby incorporated by reference.

Representative water-soluble polyoxyethylated esters having about 5 to about 20 moles of oxide per mole are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

Conventional sulfur compound additives may also be incorporated in the hydraulic fluid such as the ammonia, amine or metal salts of 2-mercaptobenzothiazole or 5-, 6- and 7-substituted 2-mercaptobenzothiazole, said salts being formed on neutralization of the free acid form of 2-mercaptobenzothiazole with a base. Such sulfur compounds are disclosed particularly beginning in column 5 of U.S. Pat. No. 4,138,346 which is hereby incorporated by reference.

The sulfur-containing compound may also be sulfurized oxymolybdenum and oxyantimony compounds represented by:

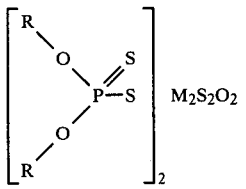

$M_2S_2O_2$ wherein M is molybdenum or antimony and R is organic and is selected from the group consisting of $C_3$–$C_{20}$ alkyl, aryl, alkylaryl radicals and mixtures thereof.

Representative useful molybdenum and antimony compounds are sulfurized oxymolybdenum or oxyantimony organo-phosphorodithioate where the organic portion is alkyl, aryl or alkylaryl and wherein said alkyl has a chain length of 3 to 20 carbon atoms.

The compositions of the invention may also contain a phosphate ester selected from the group consisting of $$RO-(EO)_n-\overset{\overset{\displaystyle O}{|}}{\underset{\underset{\displaystyle |}{}}{P}}-OX \text{ and } R-O-(EO)_n-\overset{\overset{\displaystyle O}{|}}{\underset{\underset{\displaystyle |}{}}{P}}-(EO)_n-OR$$

and mixtures thereof wherein ethylene oxide groups are represented by EO; R is selected from the group consisting of linear or branched chain alkyl groups wherein said alkyl groups have about 6 to 30 carbon atoms, preferably about 8 to 20 carbon atoms, or alkylaryl groups wherein the alkyl groups have about 6 to 30 carbon atoms, preferably about 8 to 18 carbon atoms, and X preferably is selected from the group consisting of hydrogen, alkali or alkaline earth metal, the residue of ammonia or an amine and mixtures thereof, and n is a number from 1 to 50. Metals such as lithium, sodium, potassium, rubidium, cesium, calcium, strontium, and barium are examples of the alkali or alkaline earth metal.

The free acid form of the phosphate ester is preferably utilized in preparing hydraulic fluids in accordance with compositions of the invention. These are more fully disclosed in U.S. Pat. Nos. 3,004,056 and 3,004,057, incorporated herein by reference. The free acid form may be converted to the salt form in situ in the preparation of the hydraulic fluids of the invention. Alternatively, the phosphate ester salts can be used directly.

The hydraulic fluid compositions of the invention may also contain an alkyldialkanolamide of the formula

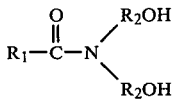

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl dicarboxylic acid and removing water of esterification. Useful alkyl dicarboxylic acids include branched or straight chain saturated or unsaturated aliphatic monocarboxylic or dicarboxylic acids as described below. Preferably, the saturated straight chain acids are used and the preferred amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid of the invention are resistance to precipitation in the presence of hard water, that is, in the presence of large amounts of calcium and magnesium ions in the water utilized to prepare the hydraulic fluid of the invention. In addition, the alkyldialkanolamides contribute to the antiwear and extreme pressure performance of the composition as well as to the metal corrosion resistance which is desirable in such fluids. The alkyldialkanolamides in aqueous solution are completely stable under neutral and alkaline conditions and show little tendency to hydrolyze or decompose on storage.

The hydraulic fluids and metalworking compositions of the invention generally consist of about 60 percent to about 99 percent water and about 40 percent to about 1 percent of additives. A high water hydraulic fluid will generally contain 95 percent or more of water. These additives can consist of concentrates comprising 2-ethylhexanol possibly in combination with the water-soluble esters of ethoxylated aliphatic acid and/or ethoxylated alcohol ethers and/or sulfur containing compound; and/or phosphate ester, and/or alkyldialkanolamide and, in addition, can contain defoamers, thickeners, additional corrosion inhibitors and metal deactivators or chelating agents. Preferably, said fluids consist of about 75 percent to 99 percent water and about 25 percent to about 1 percent concentrate. The fluids are easily formulated at room temperature using distilled or deionized water although tap water can also be used without adverse effects on the fluid properties.

The amount of 2-ethylhexanol in the concentrate is preferably from about 1 to 20 percent by weight of the concentrate.

The amount of sulfur-containing compound in the hydraulic fluid concentrate of the invention is generally about 0 to 10 percent by weight and when employed is at a minimum of 1.0 percent. The concentration of the phosphate ester in the hydraulic fluid concentrate of the invention is generally about 1.0 to 20.0 percent by weight of the concentrate. The concentration of the water-soluble ester of the ethoxylated aliphatic acid and/or ethoxylated alcohol ether in the hydraulic fluid concentrate of the invention is generally about 1.0 percent to about 7.0 percent by weight. Preferably, the proportion by weight of each of these components is 1.0 to 5.0 percent.

The percent by weight alkyldialkanolamide in the concentrate is about 1 to 20, preferably about 1 to 5 based upon the total weight of the concentrate. Most preferably, equal amounts of the ester of an ethoxylated aliphatic alcohol and the alkyldialkanolamide are used.

The thickeners, metal deactivators and corrosion inhibitors which can be added either to the concentrate or to the hydraulic fluid or metalworking compositions of the invention are as follows:

The thickener can be of the polyglycol type. Such thickeners are well known in the art and this type of thickener is the preferred thickener. The polyglycol thickeners are well known in the art and are polyoxyalkylene polyols, having a molecular weight of about 2,000 to 75,000, prepared by reacting an alkylene oxide with a linear or branched chain polyhydric alcohol. Suitable polyols are prepared from ethylene oxide and propylene oxide in a mole ratio of between about 100:0 to about 70:30 ethylene oxide:propylene oxide. Such thickeners are commercially available and sold under the trademark "Ucon 75H-90,000" by Union Carbide and Carbon Chemical Corporation. The specifications for this material call for a pour point of 40° F., a flash point of 485° F., a specific gravity at 20° C. of approximately 1:1 and a viscosity of about 90,000 S.U.S. at a temperature of 100° F.

Preferred polyether polyol thickeners utilized to thicken the hydraulic fluids of the invention can be obtained by modifying a conventional polyether polyol thickening agent such as described above with an alpha olefin epoxide having about 12 to 18 carbon atoms or mixtures thereof. Actually, any epoxide with a molecular weight above approximately 150 may be employed. Any alcohol or aliphatic (or possibly even aromatic) group of 10 to 24 carbons that can be placed at the end of the polyol chain may be employed in lieu of the alpha-olefin epoxide. Glycidyl ethers make excellent caps. A little ethylene oxide, propylene oxide or butylene oxide beyond the cap may be employed. The conventional polyether polyol thickening agent can be an ethylene oxide homopolymer or a heteric or block copolymer of ethylene oxide and at least one lower alkylene oxide having 3 to 4 carbon atoms. Said ethylene oxide is used in the proportion of at least about 10 percent by weight based upon the total weight of the polyether polyol. Generally, about 70 to 99 percent by weight ethylene oxide is utilized with about 30 to 1 percent by weight of lower alkylene oxide having 3 to 4 carbon atoms.

Polyether polyols are generally prepared utilizing an active hydrogen-containing compound having 1,2,3 or more active hydrogens in the presence of an acid or basic oxyalkylation catalyst and an inert organic solvent at elevated temperatures in the range of about 50° C. to 150° C. under an inert gas pressure generally from about 20 to about 100 pounds per square inch gauge. Polyether polyols suitable as thickeners can be prepared by further reacting a polyether polyol as described above having a molecular weight of about 1000 to about 75,000, preferably 1000 to about 40,000 with the above-described epoxides, alcohols, glycidyl ethers, etc. The amount of epoxide, alcohol, glycidyl ether, etc., required to obtain the modified polyether polyol thickening agents of the invention is about 1 to about 20 percent by weight based upon the total weight of the modified polyether polyol thickeners. Alternatively, the modified polyether polyol thickening agents can be obtained by the heteric copolymerization of a mixture of ethylene oxide and at least one other lower alkylene oxide having 3 to 4 carbon atoms with an alpha-olefin epoxide having about 12 to 18 carbon atoms or mixtures thereof. Further details of the preparation of the alpha-olefin epoxide modified polyether polyol thickening agents useful in the preparation of the hydraulc fluids of the invention can be obtained from co-pending applications Ser. No. 86,837 filed on Oct. 22, 1979 and Ser. No. 86,840 filed Oct. 22, 1979, both incorporated herein by reference.

Other types of thickeners or viscosity increasing agents can be used in the hydraulic fluid and metalworking compositions of the invention such as polyvinyl alcohol, polymerization products of acrylic acid and methacrylic acid, polyvinyl pyrrolidone polyvinyl ether maleic anhydride copolymer and sorbitol. These materials are well known in the art and are utilized in varying proportions depending upon the desired viscosity and the efficiency of the thickening or viscosity increasing effect.

Generally about 10 to 80 percent of thickener in the concentrate will provide the desired viscosity in the final hydraulic fluid. By the use of such thickening agents, it is believed that the hydraulic fluids of the invention prevent internal and external leakage in the mechanical parts of the hydraulic system during the pumping of such hydraulic fluids.

Liquid-vapor corrosion inhibitors may be employed and can be any of the alkali metal nitrites, nitrates and benzoates. Certain amines are also useful. The inhibitors can be used individually or in combinations. Representative examples of the preferred alkali metal nitrates and benzoates which are useful are as follows: sodium nitrate, potassium nitrate, calcium nitrate, barium nitrate, lithium nitrate, strontium nitrate, sodium benzoate, potassium benzoate, calcium benzoate, barium benzoate, lithium benzoate and strontium benzoate.

Representative amine-type corrosion inhibitors are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N-dimethyl ethanolamine, triethanolamine, diethanolamine, monoethanolamine, 2-methyl pyridine, 4-methyl pyridine, piperazine, dimethyl morpholine, $\alpha$- and $\gamma$-picoline, isopropylaminoethanol and 2-amino-2-methylpropanol. These amines also function to neutralize the free acid form of the phosphate ester converting it to the salt form.

Imidazolines can be used for their known corrosion inhibiting properties with respect to cast iron and steel. Useful imidazolines are heterocyclic nitrogen compounds having the formula:

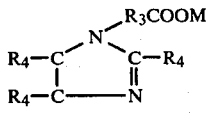

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

Particularly suitable as a corrosion inhibition agent which also improves lubricity is neodecanoic acid.

While decanoic, also known as capric, acid has been well known in the art for years, the neoacids, which are synthetic highly-branched organic acids, are relatively new. The "neo" structure is generally considered to be as follows:

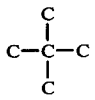

Commercially produced neodecanoic acid is composed of a number of $C_{10}$ isomers characterized by the presence of the above structure but in varying locations along the chain. It is generally a liquid with a low freezing point, i.e., less than −40° C., whereas decanoic (capric) acid is a solid melting at 31.4° C. Neodecanoic acid is synthesized starting with an olefin of mixed nonenes (at equilibrium) yielding a $C_{10}$ neoacid containing many isomers. This very highly branched and multi-isomer acid combination yields a liquid $C_{10}$ neoacid with a typical hydrocarbon-type odor. A typical structure and isomer distribution for neodecanoic acid is set forth below.

Typical Isomer Distribution for Neodecanoic Acid

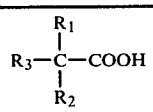

| Alkyl Group | % |
|---|---|
| $R_1$ and $R_2$ = methyl | 31 |
| $R_1$ = methyl; $R_2$ > methyl | 67 |
| $R_1$ and $R_2$ > methyl | 2 |
| $R_3$ always > methyl | |

This product is described in the article entitled "Neoacids: Synthetic Highly Branched Organic Acids," *Journal of American Oil Chemists Society,* Vol. 55, No. 4, pp. 342A to 345A (1978).

It is also contemplated to add other known corrosion inhibitors. Besides the amines, alkali metal nitrates, benzoates nitrites and neodecanoic acid listed above, the alkoxylated fatty acids are useful as corrosion inhibitors.

The above additional corrosion inhibitors are employed in the hydraulic fluid concentrates in total amount of about 1 to 40.0 percent by weight, preferably about 5 to 15 percent by weight. More specifically, it is preferred to employ benzoates or benzoic acid in amount of about 0.5 to 20 percent, amines in amount of about 1 to 20 percent, imidazolines in amount of about 1 to 20 percent and neodecanoic acid in amount of about 1 to 40 percent all by weight of the total amount of concentrate.

Metal deactivators may be used primarily to chelate copper and copper alloys. Such materials are well known in the art and individual compounds can be selected from the broad classes of materials useful for this purpose such as the various triazoles and thiazoles as well as the amine derivatives of salicylidenes. Representative specific examples of these metal deactivators are as follows: benzotriazole, tolyltriazole, 2-mercaptobenzothiazole, sodium-2-mercaptobenzothiazole, and N,N'-disalicylidene-1,2-propanediamine. The concentration of metal deactivator in the hydraulic fluid concentrates of the invention is generally about 1 to 20 percent by weight and preferably about 3 to 5 percent by weight.

Additional defoamers such as the well known organic surfactant defoamers and other conventional defoamers, for example nonionic defoamers such as the polyoxyalkylene type nonionic surfactants, may also be employed in normal amounts. Preferred amounts are about 0.5 to 20.0 percent by weight of the total amount of concentrate. The concentrate may contain other conventional hydraulic fluid additives and possibly some impurities in normal minimal amounts.

The phosphate esters and esters of ethoxylated aliphatic acids and alcohols are water-soluble in the sense that no special method is required to disperse these materials in water and keep them in suspension over long periods of time. As a means of reducing corrosion, the pH of the water in the fluids of the invention is maintained above 7.0, preferably 7.0 to about 11.0, and most preferably 9 to about 10.5. Preferably, pH of the fluid concentrates is adjusted with an alkali metal or alkaline earth metal hydroxide, or carbonate, ammonia or an amine. Where these are employed, benzoic acid may be employed in lieu of alkali metal benzoates. The sulfurized molybdenum or antimony compounds on the other hand are insoluble in water and require emulsification prior to use, for instance, with anionic or nonionic surfactants. Useful representative anionic or nonionic surfactants are: sodium petroleum sulfonate, i.e., sodium dodecylbenzene sulfonate; polyoxyethylated fatty alcohol or fatty acid and polyoxyethylated alkyl phenol.

The concentrates of the hydraulic fluids of this invention can be made up completely free of water or contain any desired amount of water but preferably contain up to 85 percent by weight of water to increase fluidity and provide ease of blending at the point of use. As pointed out above, these concentrates are typically diluted with water in the proportion of 1:99 to 40:60 to make up the final hydraulic fluid.

The preferred final hydraulic fluid of the invention contains 0.1 to 2 percent by weight of 2-ethylhexanol and optionally may include by weight one or more of the following:

about 0.01 to 3.0 percent water soluble ester of exothylated aliphatic acid and/or ethoxylated alcohol ether, about 0.01 to 2.0 percent sulfur-containing compound, about 1.0 to 20.0 percent thickener, about 0.01 to 3.0 percent ethoxylated phosphate ester, or salt thereof, about 0.01 to 3 percent alkyldialkanolamide, about 0.05 to 10 percent corrosion inhibitors and most preferably about 0.01 to 2 percent benzoic acid and/or benzoates, about 0.02 to 2 percent amine type corrosion inhibitors about 0.02 to 2 percent ethoxylated imidazoline and about 0.1 to 2 percent neodecanoic acid, about 0.02 to 5 percent metal deactivators, about 0.01 to 2 percent additional defoamers plus other conventional additives such as dyes and impurities in normal amounts. For a high water fluid the total amount of additives should not exceed 5 percent.

The following examples more fully describe the hydraulic fluids of the invention and show the unexpected results obtained by their use.

In the examples: Thickener #1 is a branched heteric copolymer of ethylene oxide, and 1,2-propylene oxide using trimethylol propane as an initiator and containing 85 percent oxyethylene units, and 15 percent oxypropylene units. This basic heteric copolymer is further reacted with a mixture of alpha olefin epoxides having 15 to 18 carbon atoms. The molecular weight is about 17,000.

Thickener #2 is a branched heteric copolymer of ethylene oxide and 1,2-propylene oxide using trimethylol propane as an initiator and containing 85 percent oxyethylene units, and 15 percent oxypropylene units. This basic heteric copolymer is further reacted with a mixture of alpha olefin epoxides having 15 to 18 carbon atoms. The total molecular weight is about 12,000.

The polyoxyalkylene defoamer is the polyoxyethylene adduct of a polyoxypropylene hydrophobic base, said hydrophobic base having a molecular weight of about 1750 wherein the oxypropylene content is about 90 weight percent of the molecule. This product is readily available on the market under the trademark Pluronic ®L-61.

The ethoxylated phosphate ester utilized in the examples is reputed to be produced by the reaction of one mole of phosphorus pentoxide with a condensation product of one mole of nonylphenol and approximately 4 moles of ethylene oxide in accordance with the methods disclosed in U.S. Pat. Nos. 3,004,056 and 3,004,057.

The examples are intended for the purpose of illustration. Throughout the application, all parts, proportions, and percentages are by weight and all temperatures are in degrees centigrade unless otherwise noted.

EXAMPLES 1-7

A hydraulic fluid concentrate was prepared by blending 76.5 parts by weight of water, 3.0 parts by weight of ethoxylated phosphate ester, 3.0 parts by weight of a $C_{21}$ diethoxylated diacid mixed with a $C_{21}$ diethanol diamide, 5 parts by weight of 2-amino-2-methyl-1-propanol (95 percent aqueous solution), 4.5 parts by weight of a 50 percent by weight aqueous solution of tolyltriazole, 4 parts by weight of a 95 percent 2-heptyl-1-(ethoxypropionic acid) imidazoline, sodium salt in 5 percent of ethanol, 2 parts by weight of polyoxyalkylene defoamer and 2 parts by weight benzoic acid.

From the above concentrate, the fluids of the following examples were prepared having compositions a shown in Table I below. Foam tests were run on each composition wherein gas was bubbled into 200 millimeters of each fluid in a 1000 milliliter graduated cylinder for five minutes. The time required for each foam to break is set forth in the table below. If the foam did not break after ten minutes, >600 sec. is recorded in the table.

TABLE I

| | Weight % | | | | | | |
|---|---|---|---|---|---|---|---|
| | 1 | 2 | 3 | 4 | 5 | 6 | 7 |
| Concentrate | 5.0 | 5.0 | 5.0 | 5.0 | 5.0 | 5.0 | 5.0 |
| Thickener #1 | 2.25 | 2.25 | 2.25 | 2.25 | — | 2.25 | 2.25 |
| Thickener #2 | — | — | — | — | 4.0 | — | — |
| Neodecanoic Acid | — | — | — | — | 0.3 | — | — |
| 2-ethylhexanol | 0 | 0.05 | 0.1 | 0.2 | 0.2 | 0.5 | 1.0 |
| NaOH in amount sufficient to give a pH of 10 | | | | | | | |
| Water | Balance | Balance | Balance | Balance | Balance | Balance | Balance |
| Break time, Sec. | >600 | >600 | >600 | 304 | 394 | 234 | 205 |

EXAMPLES 8-10

Final hydraulic fluids were prepared having the compositions shown in Table II below. These compositions were subjected to the foam test described in connection with Examples 1-7 above and the break times are set forth in Table II below.

TABLE II

| | Weight % | | |
|---|---|---|---|
| Example | 8 | 9 | 10 |
| Tolyltriazole (50% aqueous solution) | 0.225 | 0.225 | 0.225 |
| 2-amino-2-methylpropanol (95% aqueous solution) | 0.25 | 0.25 | 0.25 |
| Ethoxylated Phosphate Ester | 0.15 | 0.15 | 0.15 |
| Alkyldiethanolamide (same as Examples 1-7) | 0.15 | 0.15 | 0.15 |
| Benzoic acid | 0.1 | 0.1 | 0.1 |
| 2-heptyl-1-(ethoxypropionic acid)imidazoline | 0.2 | 0.2 | 0.2 |
| Neodecanoic acid | 0.3 | 0.3 | 0.3 |
| 2-Ethylhexanol | 0 | 0.2 | 0 |
| n-octanol | 0 | 0 | 0.2 |
| Polyoxyalkylene polymeric thickener #1 | 2.0 | 2.0 | 2.0 |
| Polyoxyalkylene defoamer | 0.1 | 0.1 | 0.1 |
| NaOH (50% in water) | 0.5 | 0.5 | 0.7 |
| Water | Balance | Balance | Balance |
| Break time, sec. | >600 | 165 | >600 |

While this invention has been described with reference to certain specific embodiments, it will be recognized by those skilled in the art that many variations are possible without departing from the scope and spirit of the invention.

The embodiments of the invention in which an exclusive privilege or property is claimed are defined as follows:

1. A hydraulic fluid concentrate characterized by improved low-foaming properties comprising water, about 0.15 to 2 percent by weight of 2-ethylhexanol, and conventional hydraulic fluid additives wherein said concentrate includes a thickener and at least one additive selected from the group consisting of phosphate esters or salts thereof selected from the group consisting of $$RO-(EO)_n-\underset{\underset{OX}{|}}{\overset{\overset{O}{\|}}{P}}-OX \text{ and } R-O-(EO)_n-\underset{\underset{OX}{|}}{\overset{\overset{O}{\|}}{P}}-(EO)_n-OR$$

and mixtures thereof wherein ethylene oxide groups are represented by EO; R is selected from the group consisting of linear or branched chain alkyl groups wherein said alkyl groups have about 6 to 30 carbon atoms or alkylaryl groups wherein the alkyl groups have about 6 to 30 carbon atoms and X is selected from the group consisting of hydrogen, alkali or alkaline earth metal, the residue of ammonia or an amine and mixtures thereof, and n is a number from 1 to 50;

an alkyldialkanolamide of the formula

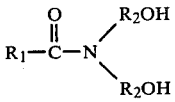

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

a corrosion inhibitor;

an additional defoamer;

water-soluble ethers or esters of ethoxylated $C_8$–$C_{36}$ aliphatic monohydric or polyhydric alcohols or acids, sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

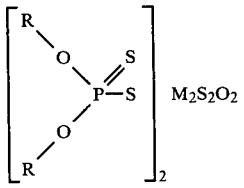

wherein M is molybdenum or antimony and R is organic and is selected from the group consisting of $C_3$–$C_{20}$ alkyl, aryl, alkylaryl radicals and mixtures thereof, and wherein said thickener is a polyether polyol having a molecular weight of about 1000 to about 40,000 prepared by reacting ethylene oxide or ethylene oxide and at least one lower alkylene oxide having 3 to 4 carbon atoms with at least one active hydrogen-containing compound and at least one alpha-olefin oxide or glycidyl ether having a carbon chain length of about 12 to 18 aliphatic carbon atoms wherein said alpha-olefin oxide or glycidyl ether is present in the amount of 1 to about 20 percent by weight based upon the total weight of said thickener.

2. The concentrate of claim 1 wherein the amount of said additives is by weight about 1.0 to 20.0 percent phosphate ester, about 1.0 to 20.0 percent alkyl dialkanolamide, about 1.0 to 20.0 percent metal deactivator, about 0.02 to 2 percent additional defoamer, about 1 to 40 percent corrosion inhibitor, about 1 to 7 percent of said water-soluble ethers or esters; about 0 to 10 percent of said sulfur compound, and about 10 to 80 percent thickener.

3. The concentrate of claim 1 wherein said additional corrosion inhibitors include nitrates; nitrites; benzoates; neodecanoic acid, amines, and imidazolines having the formula:

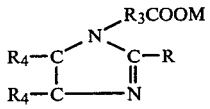

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

4. The concentrate of claim 3 wherein the amount by weight of said phosphate ester is about 1.0 to 20.0 percent, said alkyl dialkanolamide is about 1.0 to 20.0 percent, said metal deactivator is about 1.0 to 20.0 percent, said additional defoamer is about 0.02 to 20.0 percent, said imidazoline is about 1.0 to 20.0 percent, said benzoate is about 0.5 to 20.0 percent, said amine is about 1.0 to 20.0 percent, said neodecanoic acid is about 1 to 40 percent, said water-soluble ether or ester is about 1.0 to 7 percent and said thickener is about 10.0 to 80.0 percent.

5. A hydraulic fluid characterized by improved low-foaming properties comprising water, about 0.15 to 2 percent by weight of 2-ethylhexanol and conventional hydraulic fluid additives wherein said fluid includes a thickener and at least one additive selected from the group consisting of phosphate esters or salts thereof selected from the group consisting of

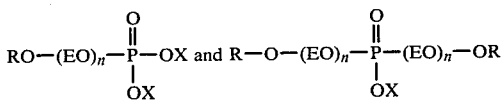

and mixtures thereof wherein ethylene oxide groups are represented by EO; R is selected from the group consisting of linear or branched chain alkyl groups wherein said alkyl groups have about 6 to 30 carbon atoms or alkyklaryl groups wherein the alkyl groups have about 6 to 30 carbon atoms and X is selected from the group consisting of hydrogen, alkali or alkaline earth metal, the residue of ammonia or an amine and mixtures thereof, and n is a number from 1 to 50;

an alkyldialkanolamide of the formula

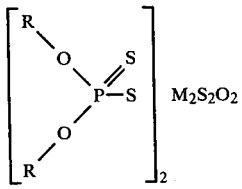

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

an additional defoamer;

a corrosion inhibitor;

water-soluble ethers or esters of ethoxylated $C_8$–$C_{36}$ aliphatic monohydric or polyhydric alcohols or acids, sulfur compound additives selected from the group consisting of the ammonia, amine or metal salts of 2-mercaptobenzothiazole or 5-, 6- and 7-substituted 2-mercaptobenzothiazole, and sulfurized molybdenum and antimony compounds represented by the formula:

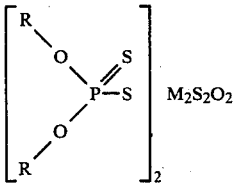

wherein M is molybdenum or antimony and R is organic and is selected from the group consisting of $C_3$–$C_{20}$ alkyl, aryl, alkylaryl radicals and mixtures thereof, and wherein said thickener is a polyether polyol having a molecular weight of about 1000 to about 40,000 prepared by reacting ethylene oxide or ethylene oxide and at least one lower alkylene oxide having 3 to 4 carbon atoms with at least one active hydrogen-containing compound and at least one alpha-olefin oxide or glycidyl ether having a carbon chain length of about 12 to 18 aliphatic carbon atoms wherein said alpha-olefin oxide or glycidyl ether is present in the amount of 1 to about 20 percent by weight based upon the total weight of said thickener.

6. The hydraulic fluid of claim 5 wherein the amount of said additives is by weight about 0.01 to 3.0 percent phosphate ester, about 0.01 to 3.0 percent alkyl dialkanolamide, about 0.02 to 5.0 percent metal deactivator, about 0.05 to 2.0 percent additional defoamer, about 0.05 to 10 percent corrosion inhibitor, about 0.01 to 3 percent of said water-soluble ethers or esters; about 0.01 to 2 percent of said sulfur compound, about 0.1 to 2 percent neodecanoic acid, and about 1 to 20 percent thickener.

7. The hydraulic fluid of claim 5 wherein said corrosion inhibitors include nitrates; nitrites; benzoates; neodecanoic acid, amines, and imidazolines having the formula:

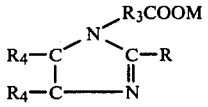

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

8. The hydraulic fluid of claim 7 wherein the amount by weight of said phosphate ester is about 0.01 to 3.0 percent, said alkyl dialkanolamide is about 0.01 to 3 percent, said metal deactivator is about 0.02 to 5.0 percent, said additional defoamer is about 0.02 to 2 percent, said imidazoline is about 0.02 to 2 percent, said benzoate is about 0.01 to 2 percent, said amine is about 0.02 to 2 percent, said neodecanoic acid is about 0.1 to 2.0 percent, said water soluble ethers or esters is about 0.01 to 3 percent, said sulfur-containing compound is about 0.01 to 2 percent, and said thickener is about 1 to 20 percent.

9. A method of improving low foam properties in a hydraulic fluid comprising blending with said fluid at least about 0.15 percent by weight of 2-ethylhexanol and wherein said hydraulic fluid includes at least one additive selected from the group consisting of phosphate esters or salts thereof selected from the group consisting of

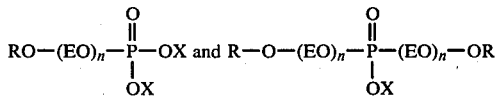

and mixtures thereof wherein ethylene oxide groups are represented by EO; R is selected from the group consisting of linear or branched chain alkyl groups wherein said alkyl groups have about 6 to 30 carbon atoms or alkylaryl groups wherein the alkyl groups have about 6 to 30 carbon atoms and X is selected from the group consisting of hydrogen, alkali or alkaline earth metal, the residue of ammonia or an amine and mixtures thereof, and n is a number from 1 to 50;

an alkyldialkanolamide of the formula

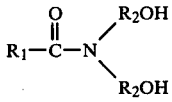

wherein $R_1$ is alkyl of about 4 to about 54 carbon atoms and $R_2$ is alkyl of about 2 to about 6 carbon atoms, or an alkyldialkanolamide prepared by esterifying a dialkanolamine with an alkyl carboxylic acid and removing water of esterification wherein said alkyldialkanolamide is derived from a branched or straight chain, saturated or unsaturated aliphatic dicarboxylic acid having 8 to 54 carbon atoms, a metal deactivator;

an additional defoamer;

a corrosion inhibitor;

water-soluble ethers or esters of ethoxylated $C_8$–$C_{36}$ aliphatic monohydric or polyhydric alcohols or acids, sulfur compound additives selected from the group consisting of the ammonia, amine or metal salts of 2-mercaptobenzothiazole of 5-, 6- and 7-substituted 2-merceptobenzothiazole, and sulfurized molybdenum and antimony compounds represented by the formula:

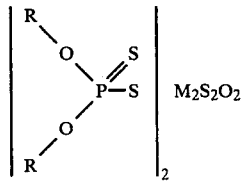

wherein M is molybdenum or antimony and R is organic and is selected from the group consisting of $C_3$-$C_{20}$ alkyl, aryl, alkylaryl radicals and mixtures thereof, and wherein said thickener is a polyether polyol having a molecular weight of about 1000 to about 40,000 prepared by reacting ethylene oxide or ethylene oxide and at least one lower alkylene oxide having 3 to 4 carbon atoms with at least one active hydrogen-containing compound and at least one alpha-olefin oxide or glycidyl ether having a carbon chain length of about 12 to 18 aliphatic carbon atoms wherein said alpha-olefin oxide or glycidyl ether is present in the amount of 1 to about 20 percent by weight based upon the total weight of said thickener.

10. The method of claim 9 wherein the amount of said additives in said hydraulic fluid is by weight about 0.01 to 3.0 percent phosphate ester, about 0.01 to 3.0 percent alkyl dialkanolamide, about 0.02 to 5.0 percent metal deactivator, about 0.01 to 2.0 percent additional defoamer, about 0.05 to 10 percent corrosion inhibitor, about 0.01 to 3 percent of said water-soluble ethers or esters; about 0.01 to 2 percent of said sulfur compound, and about 1 to 20 percent thickener.

11. The method of claim 9 wherein said additional corrosion inhibitors include nitrates; nitrites; benzoates; neodecanoic acid, amines, and imidazolines having the formula:

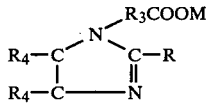

wherein $R_4$ is hydrogen or a monovalent radical selected from the group consisting of alkyl of 1 to 18 carbon atoms, alkylene of 1 to 18 carbon atoms, aryl, alkylaryl having 1 to 18 carbon atoms in the alkyl portion, wherein $R_3$ is a divalent radical selected from the group consisting of alkyl and alkoxy having 2 to 18 carbon atoms where the alkoxy is derived from alkylene oxides selected from the group consisting of ethylene oxide, propylene oxide, butylene oxide, tetrahydrofuran and mixtures thereof and wherein M is an alkali metal.

12. The method of claim 11 wherein the amount by weight of said phosphate ester is about 0.01 to 3.0 percent, said alkyl dialkanolamide is about 0.01 to 3 percent, said metal deactivator is about 0.01 to 5.0 percent, said defoamer is about 0.02 to 2 percent, said imidazoline is about 0.02 to 2 percent, said benzoate is about 0.01 to 2 percent, said amine is about 0.02 to 2 percent, said neodecanoic acid is about 0.15 to 2.0 percent, said water-soluble ethers or esters is about 0.01 to 3 percent, said sulfur-containing compound is about 0.01 to 2 percent, and said thickener is about 1 to 20 percent.

* * * * *